US009153904B2

(12) United States Patent
Chen et al.

(10) Patent No.: US 9,153,904 B2
(45) Date of Patent: Oct. 6, 2015

(54) ELECTRICAL CONNECTOR

(71) Applicant: BELLWETHER ELECTRONIC CORP., Taoyuan County (TW)

(72) Inventors: Kuan-Wu Chen, Taoyuan County (TW); Hsing-Yu Lee, Taoyuan County (TW)

(73) Assignee: BELLWETHER ELECTRONIC CORP., Taoyuan County (TW)

( * ) Notice: Subject to any disclaimer, the term of this patent is extended or adjusted under 35 U.S.C. 154(b) by 0 days.

(21) Appl. No.: 14/335,891

(22) Filed: Jul. 19, 2014

(65) Prior Publication Data

US 2015/0093928 A1 Apr. 2, 2015

(30) Foreign Application Priority Data

Sep. 27, 2013 (TW) ..... 102218216 U

(51) Int. Cl.
*H01R 13/627* (2006.01)
*H01R 12/75* (2011.01)

(52) U.S. Cl.
CPC ..... *H01R 13/6273* (2013.01); *H01R 12/75* (2013.01)

(58) Field of Classification Search
CPC ..... H01R 13/6273; H01R 12/75
USPC ..... 439/341, 352, 357, 372
See application file for complete search history.

(56) References Cited

U.S. PATENT DOCUMENTS

| | | | | |
|---|---|---|---|---|
| 6,830,478 | B1 * | 12/2004 | Ko | 439/579 |
| 7,112,102 | B2 * | 9/2006 | Masaki et al. | 439/682 |
| 7,172,449 | B2 * | 2/2007 | Shindo et al. | 439/341 |
| 7,430,801 | B2 * | 10/2008 | Iida et al. | 29/883 |
| 9,048,569 | B2 * | 6/2015 | Chen | 1/1 |

* cited by examiner

*Primary Examiner* — Khiem Nguyen
(74) *Attorney, Agent, or Firm* — Chun-Ming Shih; HDLS IPR SERVICES

(57) ABSTRACT

An electrical connector includes a female connector (10) and a male connector (20). The female connector (10) includes a female connector body (11) and a vertical wall (12) that define an accommodating space (17), a positioning block (13) disposed in the accommodating space (17), a latch edge (121) and a blocking wall (122) protruded from the vertical wall (12), and a latch space (18) defined by the latch edge (121) and female connector body (11). The male connector (20) having front, rear, and side end surfaces (211, 212, 213) is plugged into the accommodating space (17) and includes a male connector body (21), an extension plate (22), and a hook (23) latched to the latch edge (121), and the rear end surface (212) abuts the blocking wall (122), and the side end surface (213) has a positioning notch (217) for positioning the positioning block (13).

9 Claims, 5 Drawing Sheets

ELECTRICAL CONNECTOR

FIELD OF THE INVENTION

The present invention relates to an electrical connector, particularly to a wire-to-board electrical connector.

BACKGROUND OF THE INVENTION

In the field of electronic products, signals are transmitted through a conductive wire or a printed circuit installed on a circuit board. If it is necessary to transmit the signals from the conductive wire to a printed circuit of the circuit board or vice versa, the two are generally electrically coupled to each other through a wire-to-board electrical connector for convenient assembling.

In general, the electrical connector includes a female connector and a male connector, wherein the former has an accommodating space and a pair of latch edges; the latter includes a male connector body, a pair of elastic arms extended from the male connector body and disposed with an interval therebetween, and a hook extended from each elastic arm. When used, the male connector is installed into the accommodating space of the female connector and the hook of each elastic arm is latched to one latch edge, so that the male connector is fixed to the female connector securely.

To detach the male connector from the female connector, each elastic arm is flipped, removing each hook from its latch edge to separate the two connectors successfully. Because each elastic arm is in a slender strip shape, the structural strength is poor, as the elastic wall may be easily broken off from the male connector body when the each elastic arm is flipped. Obviously, the conventional electrical connector requires improvements.

In view of the foregoing problem, the inventor of the present invention, based on years of experience in the related industry, conducted extensive research and experiments to develop an electrical connector in accordance with the present invention to overcome the problem of the prior art.

SUMMARY OF THE INVENTION

Therefore, the present invention is to provide an electrical connector having an extension plate extended directly outwards from a front end surface of the male connector body, so that the top surface of the extension plate and the top surface of the male connector body form a linear plane, enhancing the structural strength between the extension plate and the male connector body.

Accordingly, the present invention provides an electrical connector comprising a female connector and a male connector, wherein the female connector includes a female connector body, a pair of vertical walls and a pair of positioning blocks. The pair of vertical walls are coupled to both ends of the female connector body respectively to define an accommodating space between the pair of vertical walls, and each positioning block is protruded from each vertical wall and formed in the accommodating space. A latch edge and a blocking wall are extended from both ends of each vertical wall respectively, and a latch space is formed between the latch edge and one end of the female connector body; and the male connector is plugged into the accommodating space and electrically coupled to the female connector, and the male connector includes a male connector body, an extension plate and a pair of hooks, and the male connector body has a front end surface, a rear end surface and a pair of side end surfaces, and the extension plate is extended outwardly from the front end surface, and the pair of hooks are extended from both sides of the extension plate respectively, and each hook is passed into the latch space and latched to the latch edge, and the rear end surface abuts blocking walls, and each side end surface has a positioning notch for positioning each positioning block.

The present invention further has the following effects:

1. A quick and easy assembling effect can be achieved by the design of latching the hook with the latch edge.
2. If the male connector is tugged by an unknown external force, the abutting block will press against the bottom of the abutting notch to prevent the male connector from being separated from the female connector easily.
3. The cross-sectional area of the positioning block is smaller than the cross-sectional area of the positioning notch, as the positioning block has a guiding corner for guiding the male connector body to slide into the accommodating space of the female connector successfully and easily to achieve a quick precise assembling effect.
4. The rear end surface of the male connector body abuts the blocking wall of the female connector to fix the front and rear positions of the male connector so that the conductive plate is securely and electrically coupled to the conductive wire.

DESCRIPTION OF THE PREFERRED EMBODIMENTS

Figure 1:
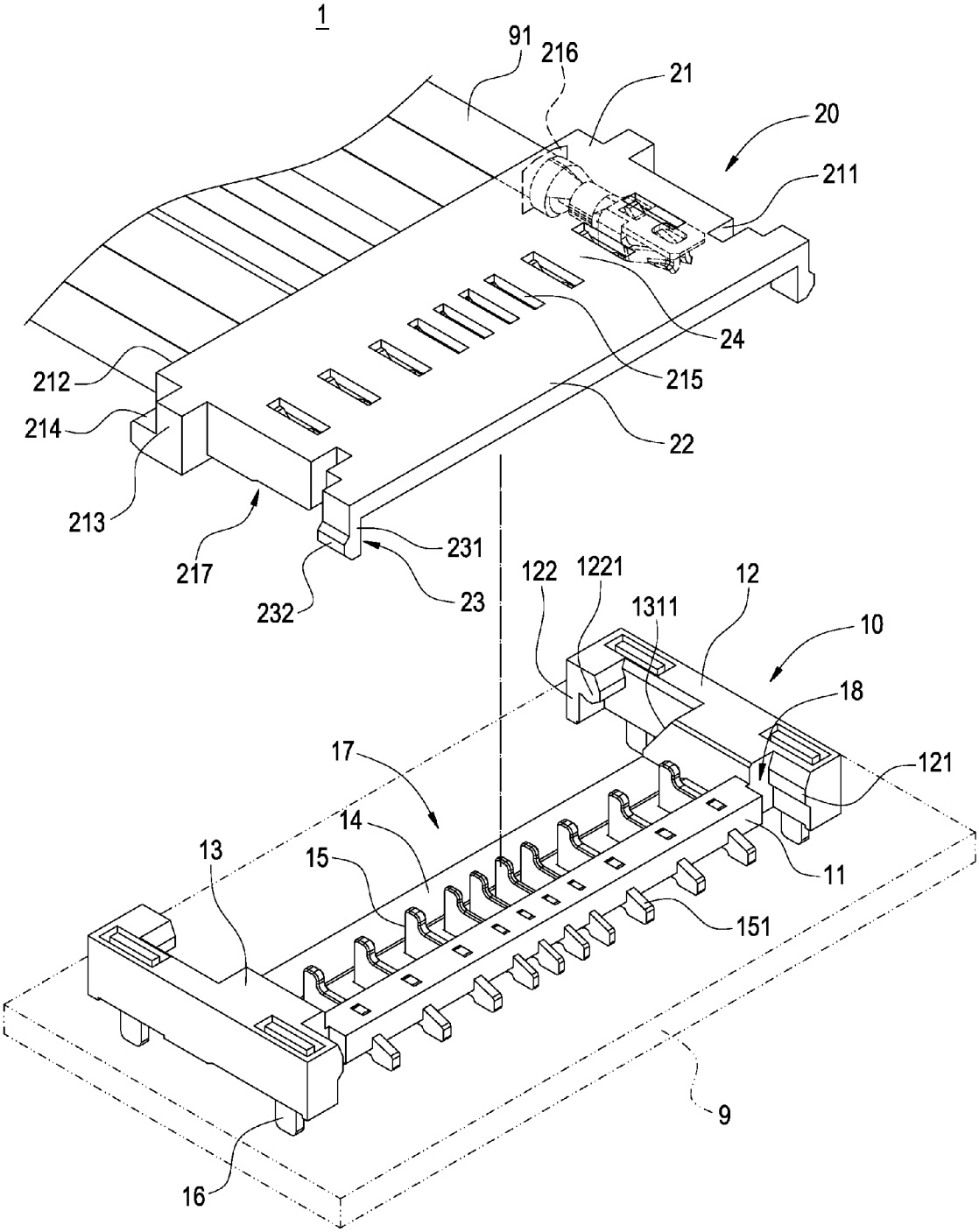
FIG. 1 is an exploded view of the present invention.

The technical contents of the present invention will become apparent with the detailed description of preferred embodiments accompanied with the illustration of related drawings as follows. It is noteworthy that same numerals are used for representing same respective elements in the drawings.

Figure 2:
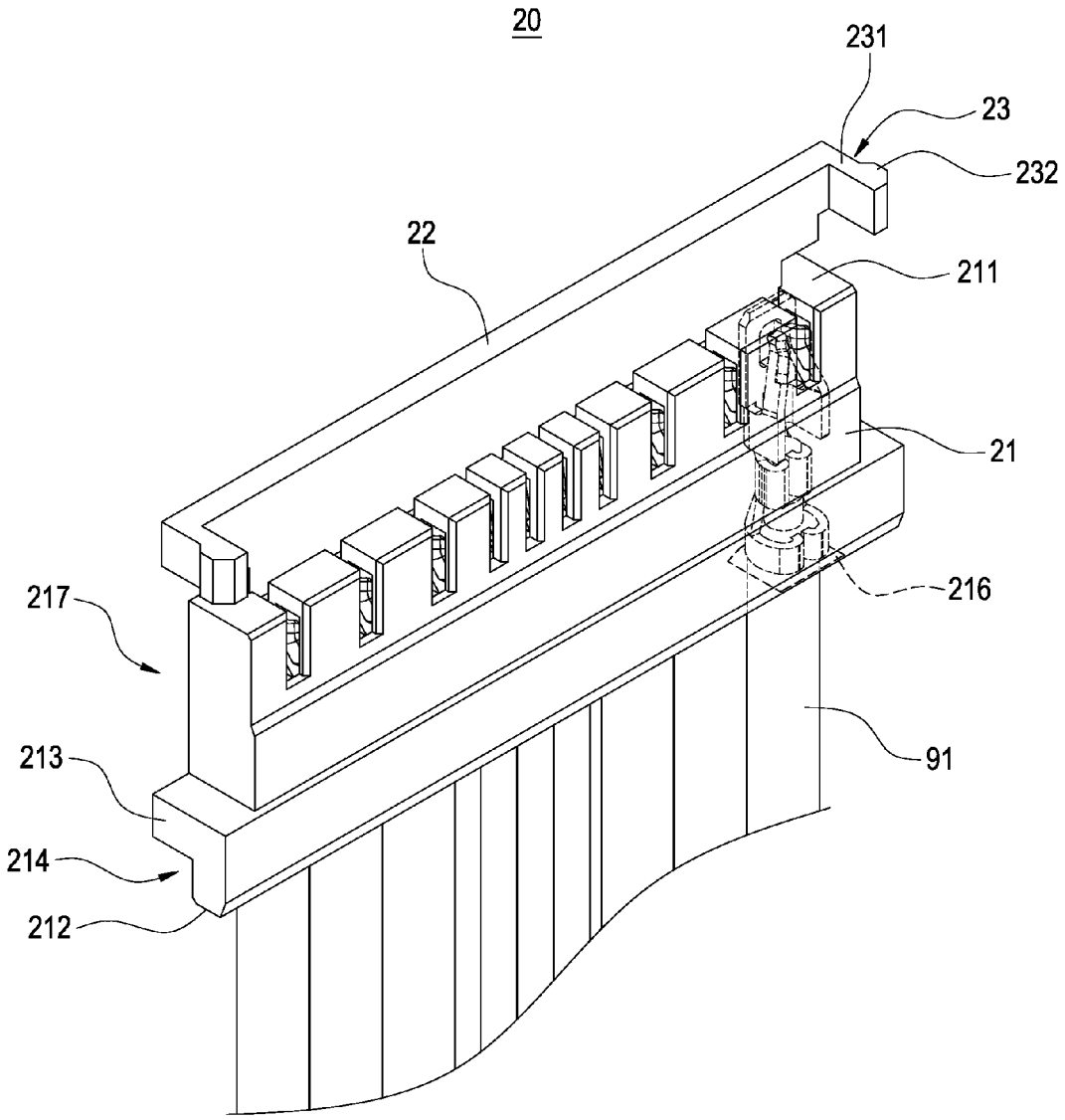
FIG. 2 is a schematic view of a male connector of the present invention.

With reference to FIGS. 1 and 2 for an exploded view of an electrical connector 1 of the present invention and a schematic view of a male connector of the present invention, the electrical connector 1 comprises a female connector 10 and a male connector 20.

The female connector 10 includes a female connector body 11, a pair of vertical walls 12, a pair of positioning blocks 13, a backplane 14, a plurality of conductive plates 15 and a plurality of fixing pins 16. The pair of vertical walls 12 are coupled to both ends of the female connector body 11 respectively and define an accommodating space 17 between the pair of vertical walls 12; each positioning block 13 is protruded from each vertical wall 12 and formed in the accommodating space 17 of the female connector 10.

A latch edge 121 and a blocking wall 122 are inwardly protruded from both ends of each vertical wall 12 respectively, and a latch space 18 is formed between the latch edge and one end of the female connector body 11, and an abutting block 1221 is formed at the top side of each blocking wall 122 and protruded towards the female connector body 11, and each positioning block 13 has a rear end surface 131, and the rear end surface 131 is disposed on a side of each positioning block 13 proximate to the blocking wall 122 and has an oblique guiding corner 1311, and the backplane 14 is installed at the bottom of the accommodating space 17 of the female connector 10, and the periphery of the backplane 14 is coupled to the female connector body 11 and each positioning block 13, and the conductive plates 15 are arranged with an interval apart from each other and perpendicularly erected on the backplane 14, and the fixing pins 16 are passed and coupled to each vertical wall 12, and an end of each fixing pin 16 is passed out from the bottom of each vertical wall 12 and plugged onto a circuit board 9.

The male connector 20 is plugged into the accommodating space 17 of the female connector 10 and electrically coupled to the female connector 10. The male connector 20 includes a male connector body 21, an extension plate 22 and a pair of hooks 23, and the male connector body 21 has a front end surface 211, a rear end surface 212, and a pair of side end surfaces 213 corresponding to one another, and the side end surfaces 213 are disposed adjacent to the front end surface 211 and the rear end surface 212.

The rear end surface 212 of the male connector body 21 abuts the blocking walls 122 of the female connector body 11, and the rear end surface 212 of the male connector body 21 proximate to both edges of each vertical wall 12 has an abutting notch 214 formed thereon and corresponsive to each abutting block 1221, and each abutting block 1221 is embedded into each respective abutting notch 214, and a side of the male connector body 21 proximate to the female connector body 11 has a plurality of through slots 215 formed thereon, and the rear end surface 212 of the male connector body 21 has a plurality of wire perforations 216 for passing a plurality of conductive wires 91, and each through slot 215 is interconnected to each respective wire perforation 216, and each conductive plate 15 of the female connector 10 is plugged into each through slot 215 of the male connector body 21. In addition, a side of each conductive plate 15 away from the male connector 20 is passed and coupled to the female connector body 11 and an end of the conductive plate 15 has a connecting section 151, and the connecting section 151 is passed and exposed from the female connector body 11, and the connecting section 151 is electrically coupled to the circuit board 9, so that the female connector 10 and the circuit board 9 are electrically coupled to each other.

Each side end surface 213 of the male connector body 21 has a positioning notch 217 formed thereon for positioning each positioning block 13 of the female connector 10, and the cross-sectional area of each positioning block 13 is smaller than the cross-sectional area of each positioning notch 217.

The extension plate 22 is extended from the front end surface 211 of the male connector body 21 to the outside, and the top surface of the extension plate 22 and the top surface of the male connector body 21 form a linear plane 24; the pair of hooks 23 are extended outwardly and respectively from both sides of the extension plate 22, and each hook 23 includes an elastic arm 231 and a latch portion 232, and each elastic arm 231 is extended outwardly from the extension plate 22 towards the female connector 10, and each latch portion 232 is protruded outwardly from each elastic arm 231 and is inserted into each latch space 18 to latch with each latch edge 121.

Figure 3:
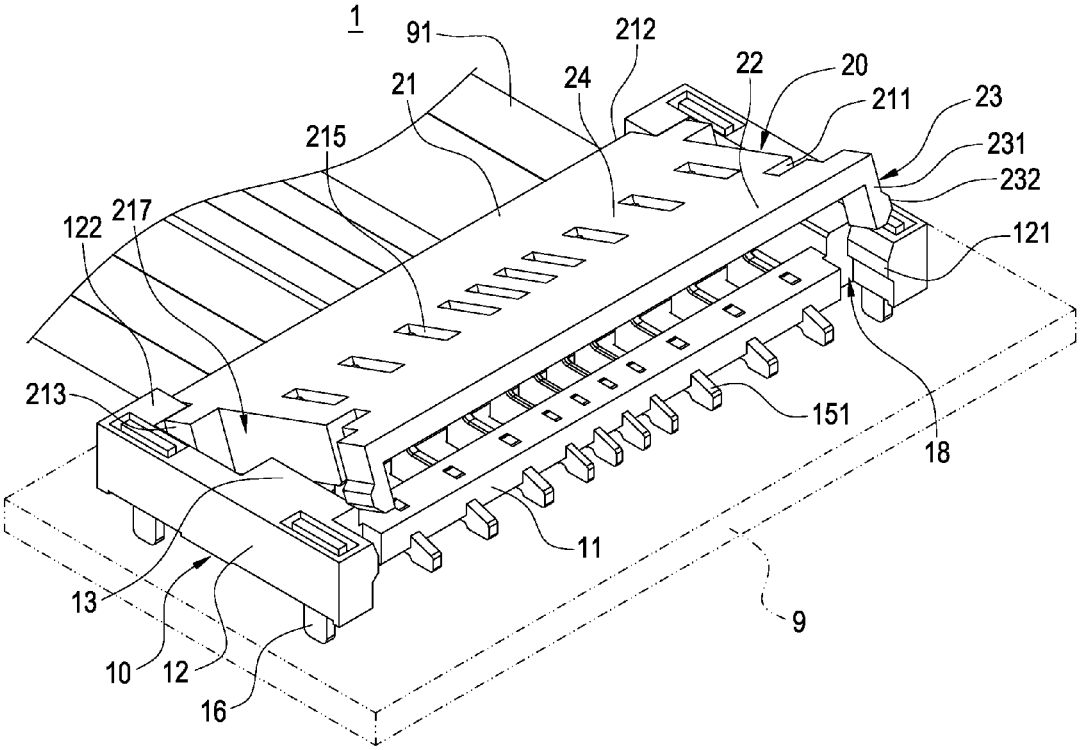
FIG. 3 is a first schematic view of an application of the present invention.
Figure 4:
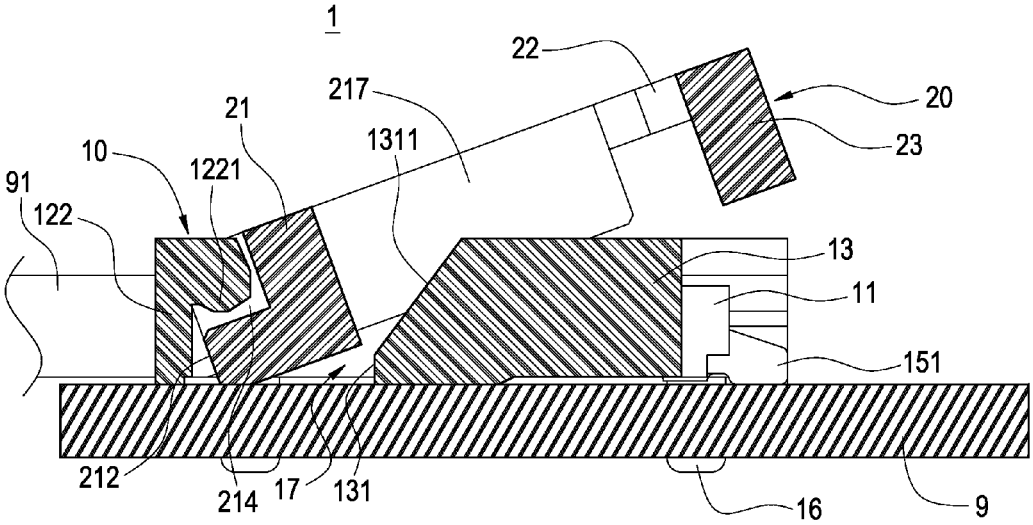
FIG. 4 is a second schematic view of an application of the present invention.

With reference to FIGS. 3 and 4 for the first and second schematic views of the applications of the present invention respectively, each fixing pin 16 of the female connector 10 is plugged into the circuit board 9 to fix the female connector 10 onto the circuit board 9, so that the connecting section 151 of each conductive plate 15 of the female connector 10 is electrically coupled to the circuit board 9, and then the conductive wires 91 are passed into each wire perforation 216 of the male connector body 21, and a side of the male connector body 21 proximate to the rear end surface 212 is put into the accommodating space 17 of the female connector 10 in a direction from top to bottom, so that the rear side of the male connector body 21 is fixed into the accommodating space 17, while each positioning block 13 of the female connector 10 is positioned in each positioning notch 217 of the male connector body 21, so that the abutting block 1211 of each blocking wall 122 is embedded into each abutting notch 214 of the male connector body 21, and the male connector body 21 may be guided by the guiding corner 1311 of each positioning block 13 to slide into the accommodating space 17 of the female connector 10 successfully in a direction from top to bottom.

Figure 5:
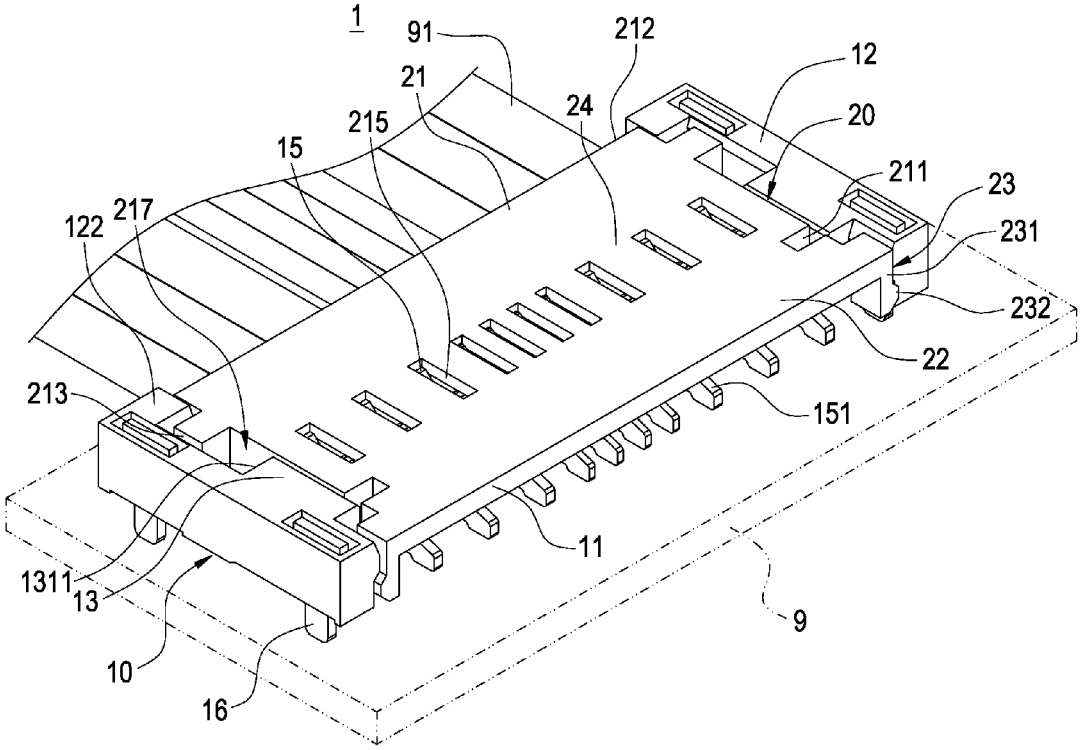
FIG. 5 is a third schematic view of an application of the present invention.
Figure 6:
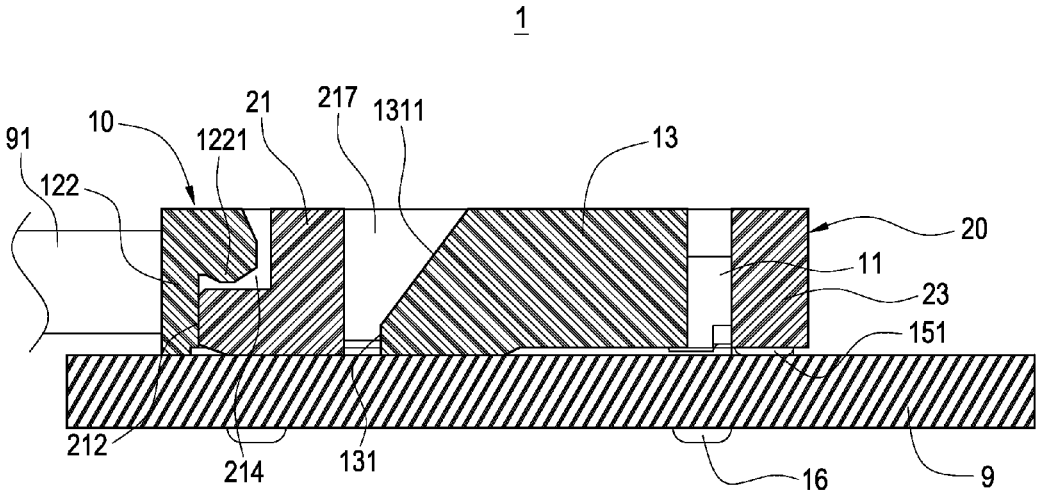
FIG. 6 is a fourth schematic view of an application of the present invention.

With reference to FIGS. 5 and 6 for the third and fourth schematic views of the applications of the present invention respectively, the extension plate 22 of the male connector 20 is pressed, so that the pair of hooks 23 are moved towards the interior of the latch space 18 of the female connector 10, so that the latch portion 232 of each hook 23 and the latch edge 121 of each vertical wall 12 are latched with each other, and the latch edge 121 of each vertical wall latches each hook 23 into each latch space 18, while each conductive plate 15 of the female connector 10 is plugged and fixed into each through slot 215 of the male connector body 21 securely, such that each conductive plate 15 is electrically coupled to each conductive wire 91 in each wire perforation 216, and the male connector 20 is electrically coupled to the female connector 10, so that each conductive wire 91 is electrically coupled to the circuit board 9 through the electric connection of each conductive plate 15, and signals at each conductive wire 91 may be transmitted to the circuit board 9 through each conductive plate 15, and signals at the circuit board 9 may be transmitted to each conductive wire 91 through each conductive plate 15.

By the design of latching each hook 23 and the latch edge 121 of each vertical wall 12, the male connector 20 is combined with the female connector 10 securely, while achieving a quick and easy assembling effect.

In addition, the abutting block 1221 of each blocking wall 122 is embedded into each abutting notch 214, so that the abutting block 1221 of each blocking wall 122 abuts the bottom of each abutting notch 214 to fix the male connector body 21 into the accommodating space 17 of the female connector 10 securely. When the circuit board 9 is turned upside down with an angle of 180° and the electrical connector 1 is situated below the circuit board 9, the male connector 20 is combined with the female connector 10 securely and will not be separated from the female connector 10 easily because the abutting block 1221 of each blocking wall 122 abuts each abutting notch 214. When the male connector 20 is affected by an unknown external force, each abutting block 1221 abuts the bottom of each abutting notch 214 to prevent the male connector 20 from being separated from the female connector 10 easily.

In addition, the cross-sectional area of each positioning block 13 is smaller than the cross-sectional area of each positioning notch 217, and each positioning block 13 has the guiding corner 1311 for guiding the male connector body 21 to slide into the accommodating space 17 of the female connector 10 easily, so as to achieve the quick and easy assembling effect.

In addition, the rear end surface 212 of the male connector body 21 abuts each blocking wall 122 of the female connector 10 to achieve the effect of positioning the male connector 20 in the front-and-rear direction, so as to ensure that each conductive plate 15 can be plugged into each through slot 215 of the male connector body 21 successfully, and each conductive plate 15 can be stably and electrically coupled to each conductive wire 91.

Figure 7:
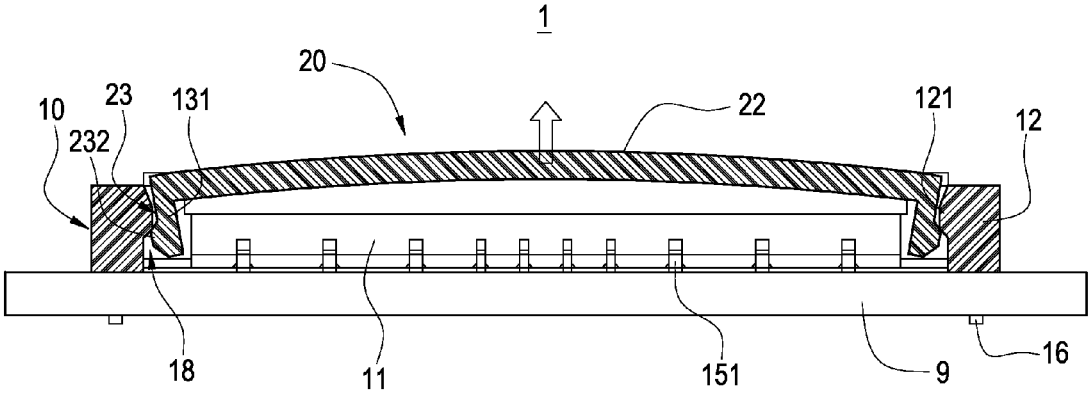
FIG. 7 is a fifth schematic view of an application of the present invention.

With reference to FIG. 7 for the fifth schematic view of the application of the present invention, when removing the male connector 20 from the female connector 10, the extension plate 22 is flipped and deformed into a convex arc shape, so that the pair of elastic arms 231 on both sides of the extension plate 22 are driven to retract towards the extension plate 22, and the pair of latch portions 232 fold the pair of elastic arms 231 to retract towards the extension plate 22 accordingly, so that each latch portion 232 is separated from each respective latch edge 121 to achieve the effect of removing the male connector 20 from the female connector 10 easily.

In addition, the top surface of the extension plate 22 and the top surface of the male connector body 21 form the linear plane 24, so that the structural strength between the extension plate 22 and the male connector body 21 is enhanced to prevent the extension plate 22 from being broken from the male connector body 21 during the process of removing the male connector 20 from the female connector 10 by flipping the extension plate 22.

While the invention has been described by means of specific embodiments, numerous modifications and variations could be made thereto by those skilled in the art without departing from the scope and spirit of the invention set forth in the claims.

What is claimed is:

1. An electrical connector, comprising:

a female connector (10), including a female connector body (11), a pair of vertical walls (12) and a pair of positioning blocks (13), and the pair of vertical walls (12) being coupled to both ends of the female connector body (11) respectively to form an accommodating space (17), and each of the positioning blocks (13) extending from each of the respective vertical wall (12) and being formed in the accommodating space (17), and a latch edge (121) and a blocking wall (122) being inwardly protruded at both ends of each vertical wall (12) respectively, and a latch space (18) being formed between the latch edge (121) and one end of the female connector body (11); and a male connector (20), plugged into the accommodating space (17), and electrically coupled to the female connector (10), and the male connector (20) including a male connector body (21), an extension plate (22) and a pair of hooks (23), and the male connector body (21) having a front end surface (211), a rear end surface (212) and a pair of side end surfaces (213), and the extension plate (22) extending to the outside from the front end surface (211), and the pair of hooks (23) extending from both sides of the extension plate (22) respectively, and each hook (23) being inserted into the latch space (18) and latching the latch edge (121), and the rear end surface (212) abutting blocking walls (122), each side end surface (213) having a positioning notch (217) for positioning each positioning block (13).

2. The electrical connector of claim 1, wherein a top surface of the extension plate (22) and a top surface of the male connector body (21) form a linear plane (24).

3. The electrical connector of claim 1, wherein each hook (23) includes an elastic arm (231) and a latch portion (232), and the elastic arm (231) extends from the extension plate (22) towards the female connector (10), and the latch portion (232) extends outwardly from the elastic arm (231), and the latch portion (232) is inserted into each latch space (18) and latched with the latch edge (121).

4. The electrical connector of claim 1, wherein the blocking wall (122) has an abutting block (1221) formed on an upper side of the blocking wall and protruded towards the female connector body (11), and two abutting notch (214) formed separately at both edges of the rear end surface (212) and configured corresponsive to the abutting block (1221), and the abutting block (1221) is embedded into the respective abutting notch (214).

5. The electrical connector of claim 1, wherein the positioning block (13) has a rear end surface (131) disposed on the positioning block (13) and proximate to a side of the blocking wall (122) and having an outwardly oblique guiding corner (1311).

6. The electrical connector of claim 1, wherein the positioning block (13) has a cross-sectional area smaller than a cross-sectional area of the positioning notch (217).

7. The electrical connector of claim 1, wherein the male connector body (21) has a plurality of through slots (215) formed thereon and proximate to a side of the female connector body (11), and the male connector body (21) has a plurality of wire perforations (216) formed on the rear end surface (212), and each through slot (215) is interconnected to each respective wire perforation (216).

8. The electrical connector of claim 7, wherein the female connector (10) further includes a backplane (14) and a plurality of conductive plates (15), and the backplane (14) is installed at the bottom of the accommodating space (17) and the periphery of the backplane (14) is coupled to the female connector body (11) and the positioning block (13), and the conductive plates (15) are arranged with an interval apart from one another and perpendicularly erected on the backplane (14), and a side of each conductive plate (15) is plugged into the corresponding through slot (215), and another side of the conductive plates (15) away from the male connector (20) is passed and coupled to the female connector body (11) and whose end is exposed to the outside from the female connector body (11).

9. The electrical connector of claim 1, wherein the female connector (10) further includes a plurality of fixing pins (16) passed and coupled to each vertical wall (12), and an end of each fixing pin (16) is passed out from the bottom of each vertical wall (12).

* * * * *